US009756449B2

(12) United States Patent
Van Der Wijst

(10) Patent No.: US 9,756,449 B2
(45) Date of Patent: Sep. 5, 2017

(54) METHOD AND DEVICE FOR PROCESSING SOUND DATA FOR SPATIAL SOUND REPRODUCTION

(75) Inventor: Johannes Hendrikus Cornelis Antonius Van Der Wijst, Nootdorp (NL)

(73) Assignee: BRIGHT MINDS HOLDING B.V., Nootdorp (NL)

( * ) Notice: Subject to any disclaimer, the term of this patent is extended or adjusted under 35 U.S.C. 154(b) by 110 days.

(21) Appl. No.: 14/129,024

(22) PCT Filed: Jun. 25, 2012

(86) PCT No.: PCT/NL2012/050447
§ 371 (c)(1),
(2), (4) Date: Dec. 23, 2013

(87) PCT Pub. No.: WO2012/177139
PCT Pub. Date: Dec. 27, 2012

(65) Prior Publication Data

US 2014/0126758 A1 May 8, 2014

(30) Foreign Application Priority Data

Jun. 24, 2011 (NL) ..... 2006997

(51) Int. Cl.
*H04S 7/00* (2006.01)

(52) U.S. Cl.
CPC ..... *H04S 7/303* (2013.01); *H04S 7/304* (2013.01); *H04S 2400/11* (2013.01)

(58) Field of Classification Search
CPC ..... H04S 7/302–7/304; H04S 2400/11
See application file for complete search history.

(56) References Cited

U.S. PATENT DOCUMENTS 5,959,597 A 9/1999 Yamada et al.
2008/0243278 A1 10/2008 Dalton et al.
(Continued)

FOREIGN PATENT DOCUMENTS

DE 10-2009-050667 4/2011

OTHER PUBLICATIONS

Search Report issued in Int'l Application No. PCT/NL2012/050447 (2013).

*Primary Examiner* — Mark Fischer
(74) *Attorney, Agent, or Firm* — Barnes & Thornburg LLP; Mark J. Nahnsen

(57) ABSTRACT

The invention relates to a method and device for processing sound data comprising determining a listener position; determining a virtual sound source position; receiving sound data; processing the sound data for reproduction by at least one speaker to let the listener perceive the processed sound data reproduced by the speaker to originate from the virtual sound position. This provides the listener with a realistic experience of sound by the speaker. Implementation of the invention allows sound data to be provided also in a dynamic environment, where positions of the listener, the virtual sound source or both can change. For example, sound data may be reproduced by a mobile device by means of headphones to a moving listener, where the virtual sound source is a shop. As the listener moves, the sound data is processed such that when reproduced via the headphones, it is perceived as to originate from the shop.

11 Claims, 10 Drawing Sheets

(56) References Cited

U.S. PATENT DOCUMENTS

2010/0328419 A1 12/2010 Etter
2011/0040395 A1* 2/2011 Kraemer ..... G10L 19/00
700/94

* cited by examiner

300

METHOD AND DEVICE FOR PROCESSING SOUND DATA FOR SPATIAL SOUND REPRODUCTION

CROSS REFERENCE TO RELATED APPLICATIONS

This patent application is a U.S. nationalization under 35 U.S.C. §371 of International Application No. PCT/NL2012/050447, filed Jun. 25, 2012, which claims priority to Netherlands Patent Application No. 2006997, filed Jun. 24, 2011. The disclosures set forth in the referenced applications are incorporated herein by reference in their entireties.

FIELD OF THE INVENTION

The invention relates to the field of sound processing and in particular to the field for creating a spatial sound image.

BACKGROUND OF THE INVENTION

Providing sound data in a realistic way to a listener, for example audio data accompanying a film on a data carrier like a DVD or BLURAY® disc, is done by pre-mixing sound data before recording it. The point of departure for such mixing is that the listener enjoys the sound data reproduced as audible sound at a fixed position, with speakers more or less provided at fixed positions in front of or around the listener.

OBJECT AND SUMMARY OF THE INVENTION

It is preferred to provide a more enhanced listening experience.

The invention provides in a first aspect a method of processing sound data comprising determining a listener position; determining a virtual sound source position; receiving sound data; processing the sound data for reproduction by at least one speaker to let the listener perceive the processed sound data reproduced by the speaker to originate from the virtual sound position.

In this way, the listener is provided with a more realistic experience of sound by the speaker.

In an embodiment of the method according to the invention, processing the sound data for reproduction comprises at least one of the following: processing the sound data such that when reproduced by the first speaker as audible sound results in a decrease of sound volume when the distance between the listener position and the virtual sound source position increases; or processing the sound data such that when reproduced by the first speaker as audible sound results in an increase of sound volume when the distance between the listener position and the virtual sound source position decreases.

With this embodiment, the listener can be provided with a more realistic experience of sound in a dynamic environment, where the listener, the virtual sound source or both have positions that are dynamic.

In a further embodiment of the method according to the invention wherein the processing of the sound data comprises processing the sound data for reproduction by at least two speakers, the two speakers are comprised by a pair of headphones arranged to be worn by a head of the listener; determining the listener position comprises determining an angular position of the headphones; processing the sound data for reproduction further comprises when the angular data indicates that the first speaker is closest to the virtual sound source position the sound data is processed such that when reproduced by the first speaker as audible sound results in an increase of sound volume and when reproduced by the second speaker as audible sound results in a decrease of sound volume.

With this embodiment, the experience of the listener is improved even further. Furthermore, with multiple headphones being operatively connected to a device that processes the audio data, individual listeners can be provided with individual experiences independently from one another, depending on their individual positions.

Another embodiment of the method according to the invention comprises providing a user interface indicating at least one virtual sound position and the listener position and the relative positions of the virtual sound position and the listener to one another; receiving user input on changing the relative positions of the virtual sound position and the listener to one another; processing further sound data received for reproduction by a speaker to let the listener perceive the processed sound data reproduced by the speaker to originate from the changed virtual sound position.

In this embodiment, data on positions is received in an efficient way and positions can be conveniently provided by a user of a device that processes the audio data.

The invention provides in a second aspect a method of recording sound data comprising: receiving first sound data through a first sound sensor; determining the position of the first sound sensor; storing the first sound data received by the sensor; storing first position data related to the position of the first sound sensor for later retrieval with the stored first sound data.

The invention provides in a third aspect a device for processing sound data comprising: a sound data receiving module for receiving sound data; a virtual sound position data receiving module for receiving sound position data; a listener position data receiving module for receiving a position of a listener; a data rendering unit for processing data arranged for processing the sound data for reproduction by at least one speaker to let the listener perceive the processed sound data reproduced by the speaker to originate from the virtual sound position.

The invention provides in a fourth aspect a device for recording sound data comprising: a sound data acquisition module arranged to be operationally connected to a first sound sensor for acquiring first sound data; and a position acquisition module for acquiring position data related to the first sound data; the device being arranged to be operationally connected to a storage module for storing the sound data and for storing the position data related to the position of the first sound sensor for later retrieval with the stored first sound data.

BRIEF DESCRIPTION OF THE DRAWINGS

The invention will now be discussed in further detail by means of Figures. In the Figures:

FIG. 6 B: shows a headphone transceiver in further detail;

DESCRIPTION OF PREFERRED EMBODIMENTS

Figure 1:
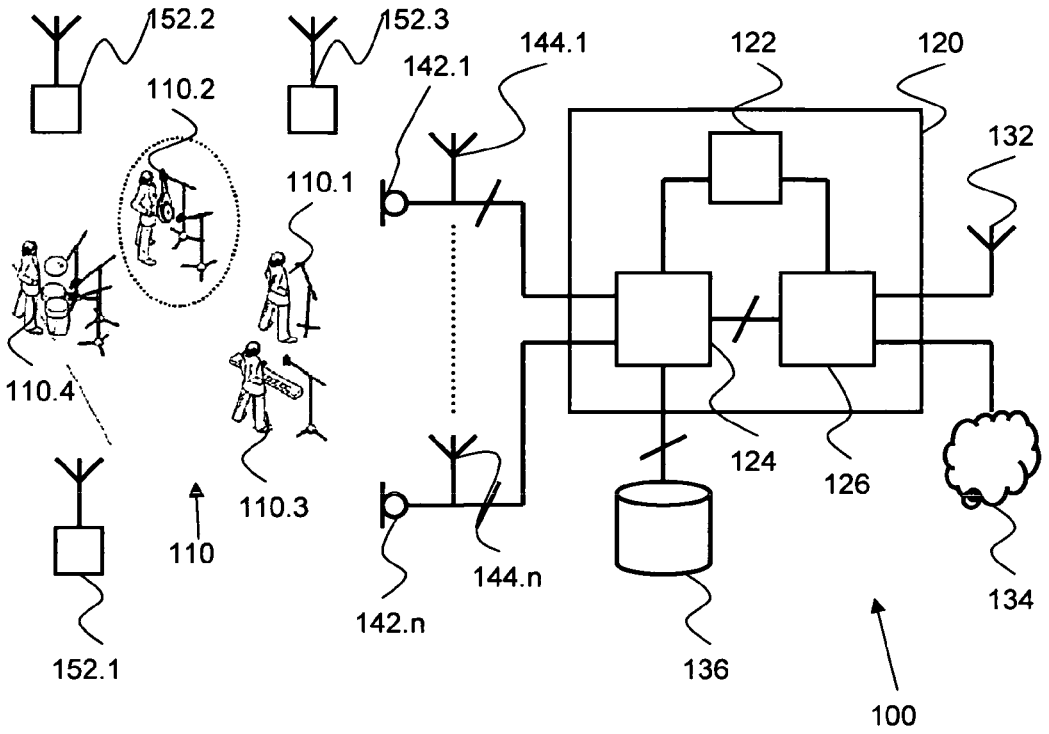
FIG. 1: shows a sound recording system.

FIG. 1 discloses a sound recording system 100 as an embodiment of the data acquisition system according to the invention. The sound recording system 100 comprises a sound recording device 120. The sound recording device 120 comprises a microprocessor 122 as a control module for controlling the various elements of the sound recording device 120, a data acquisition module 124 for acquiring sound data and related position data and a transmission module 126 that is connected to the data acquisition module 124 for sending acquired sound data and related data like position data. Optionally, a camera module (not shown) may be connected to the data acquisition module 124 as well.

The data acquisition module 124 is connected to a plurality of n microphones 142 for acquiring sound data and a plurality of n position sensing modules 144 for acquiring position data related to the microphones 142. The data acquisition module 124 is also connected to a data carrier 136 as a storage module for storing acquired sound data and acquired position data. The transmission module 126 is connected to an antenna 132 and a network 134 for sending acquired sound data and acquired position data. Alternatively, the acquired sound data and acquired position data may be processed before it is stored or sent. The network 134 may be a broadcast network like a cable television network or an address based network like internet.

In the embodiment depicted by FIG. 1, the microphones 142 record sound produced by a pop band 110 comprising a lead singer 110.1, a guitarist 110.2, a keyboard player 110.3 and a percussionist 110.4. The guitarist 110.2 is provided with two microphones 142; one for the guitar and one for singing. Sound of the electronic keyboard is acquired directly from the keyboard, without intervention of a microphone 142. Preferably, the electronic keyboard provides data on its position with the sound data provided to the data acquisition module 124. The position sensing modules 144 acquire data from a first position beacon 152.1, a second position beacon 152.2 and a third beacon 152.3. The beacons 152 are provided at a fixed location on or in the vicinity of a stage on which the pop band 110 is performing. In another alternative, the position sensing modules 144 acquire position data from one or more remote positioning systems, like GPS or Galileo.

With one microphone 142, the performance of one specific artist at a specific location is acquired and with that, also position data of the microphone 142 is acquired by means of the position sensing modules 144. With some artists running around the stage with their microphones 142 and/or instruments, it is noted that the position of the microphones 142 is not necessarily a static position. The sound and position data is acquired by the acquisition module 124. Subsequently, the acquired data is either stored on the data carrier 136 or sent by means of the transmission module 126 and the antenna 132 or the network 134, or a combination thereof. Preferably, the sound data is provided in separate streams, one stream per microphone 142. Also, each acquired stream is provided with position data acquired by the position sensing device 144 that is provided with the applicable microphone.

The position data stored and/or transmitted may either absolute position indicating an absolute geographical location or positions of the position sensing modules 144 like latitude, longitude and altitude on the globe. Alternatively, relative positions of the microphones 142 are either acquired or calculated by processing information acquired on absolute geographical location of the microphones 142.

Acquisition of relative positions of the microphones 142 is in a particular embodiment done by determining their positions with respect to the beacons 152. With respect to the beacons 152, a centre point is defined in the vicinity or in the centre of the pop band 110. Subsequently, the coordinates of the position sensing modules 144 are determined based on the distances of the position sensing modules 144 from the beacons 152.

Calculation of the relative positions of the microphones 142 is in a particular embodiment done by acquiring absolute global coordinates by the position sensing modules 144 by acquiring data from the GPS system. Subsequently, the absolute coordinates are averaged. The average is taken as the centre, after which the distance of each of the microphones 142 from the centre is calculated. This step results in coordinates per microphone 142 relative to the centre.

In yet another embodiment, the position of the microphones is pre-defined and particularly in a static way. This embodiment does not require each of the microphones 142 to be equipped with a position sensing device 144. The pre-defined position data is stored or sent together with the sound data acquired by the microphones 142 to which the pre-defined position data relates. The pre-defined position data may be defined and added manually after recording. Alternatively, the pre-defined position data is defined during or after recording by identifying a general position of a band member on a stage, either automatically or manually.

Such embodiment can be used where the microphones 142 are provided at a pre-defined location. This can for example be the case when the performance of the pop band is recorded by a so-called soundfield microphone. A soundfield microphone records signals in three directions perpendicular to one another. In addition, the overall sound pressure is measured in an omnidirectional way. In this particular embodiment, the sound is captured in four streams, where three directional sound data signals are tagged with the direction from which the sound data is acquired. The position of the microphone is acquired as well.

In the embodiments discussed here, sound data acquired by a specific microphone 142.*i* where i denotes a number from 1 to n where the sound recording system 100 comprises n microphones 142, is stored with position data identifying the position of the microphone 142.*i*, where the position data is either acquired by the position sensing device 144.*i* or is pre-defined. Storing of the position data with the related sound data may be done by means of multiplexing of streams of data, storing position data in a table, either fixed or timestamped, or by providing a separate stream.

Figure 2:
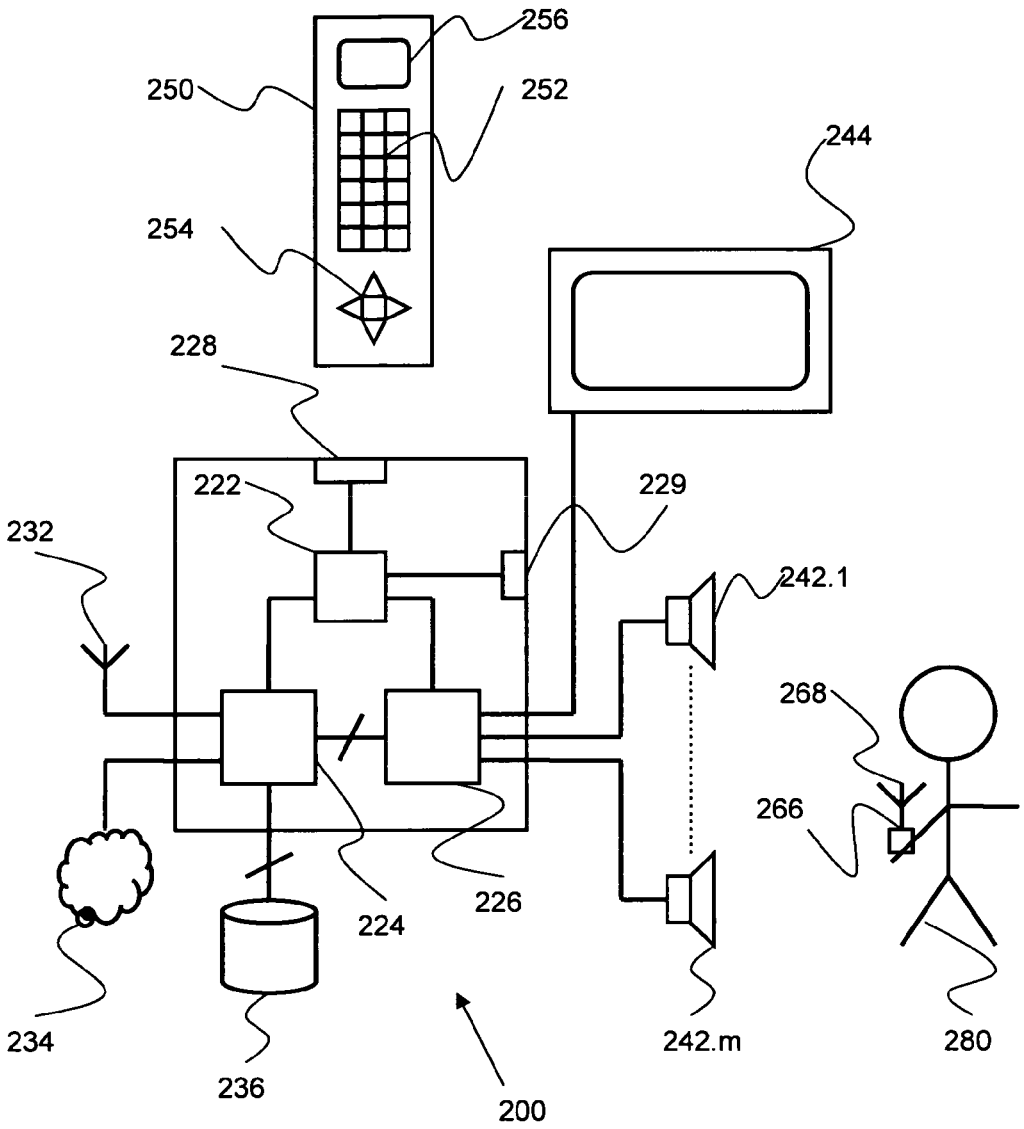
FIG. 2: shows a home cinema set with speakers.

FIG. 2 discloses a sound system 200 as an embodiment of the sound reproduction system according to the invention. The sound system 200 comprises a home cinema set 220 as an audiovisual data reproduction device comprising a data receiving module 224 for receiving audiovisual data and in particular sound data from for example the sound recording device 120 (FIG. 1) via a receiving antenna 232, a network 234 or from a data carrier 236, a rendering module 226 for rendering and amplifying audiovisual data on a screen 244 of a television or computer monitor and/or speakers 242. In a preferred embodiment, the speakers 242 are arranged around a listener 280.

The home cinema set 220 further comprises a microprocessor 222 as a controlling module for controlling the various elements of the home cinema set 220, an infra-red transceiver 228 for communicating with a remote control 250 and in particular for receiving instructions for controlling the home cinema set 220 and a sensing module 229 for sensing positions of the speakers 242 and a position of a listener listening to sound reproduced by the home cinema set 220.

Figure 3:
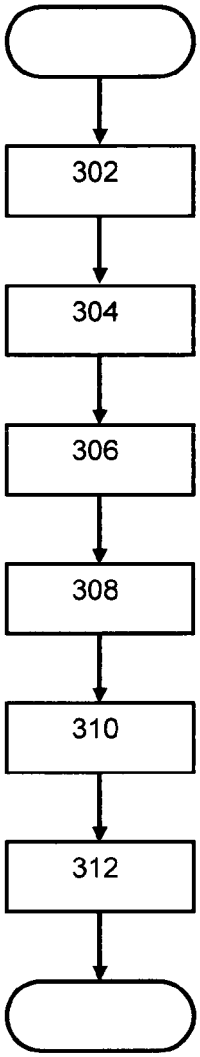
FIG. 3: shows a flowchart.

The working of the home cinema set 220 will be discussed in further detail in conjunction with FIG. 2 and FIG. 3. FIG. 3 depicts a flowchart 300, of which the table below provides short descriptions of the steps.

| Step | Description |
|---|---|
| 302 | Receive sound data |
| 304 | Receive sound source position data |
| 306 | Determine speaker position |
| 308 | Determine listener position |
| 310 | Process sound data |
| 312 | Provide processed sound data to speakers |

In a reception step 302, the data receiving module 224 receives sound data via the receiving antenna 232, the network 234 or the data carrier 236. The data may be pre-processed by downmixing an RF signal received via the antenna 232, by decoding packets received from the network 234 or the data carrier 236, by other types of processing or a combination thereof.

In a position reception step 304, position data related to the sound data is received by the data receiving module 224. As discussed above in conjunction with FIG. 1, such position data may be acquired while acquiring the sound data. As discussed above as well, the position data is or may be provided multiplexed with the sound data received. In such case, the sound data and the position data are preferably retrieved or received simultaneously, after which the sound data and the position data are de-multiplexed.

Subsequently, the position of each of the plurality of the speakers 242 is determined by means of the sensing module 229 in a step 306. To perform this step, the sensing module 229 comprises in an embodiment an array of microphones. To determine the location of the speakers, the rendering module 226 provides a sound signal to each of the speakers 242 individually. By receiving the sound signal reproduced by the speaker 242 with the array of microphones, the position of the speaker 242 can be determined. The position can be determined in a two-dimensional way using a two-dimensional array of microphones or in a three-dimensional way using a three-dimensional array of microphones. Alternatively, instead of sound, radiofrequency or infrared signals and receivers can be used as well. In such case, the speakers 242 are provided with a transmitter arranged to transmit such signals. This step comprises m sub steps for determining the positions of a first speaker 242.1 through a last speaker **242.*m*. Alternatively, the positions of the speakers 242 is available in the home cinema system 220 and in the step 306 retrieved for further use In a listener position determination step 308, the position of the listener 280 listening to sound reproduced by the speakers 242 connected to the home cinema system is determined. The listener 280 may identify himself or herself by means of a listener transponder 266 provided with a transponder antenna 268. Signals sent out by the transponder 266 are received by the sensing module 229. For that purpose, the sensing module 229 is provided with a receiver for receiving signals sent out by the transponder 266 by means of the transponder antenna 268. Alternatively or additionally, the position of the listener 280 is acquired by means of one or more optical sensors, optionally enhanced with face recognition. In particular in such alternative, the sensing module 229** is embodied as the "KINECT®" device as provided for working in conjunction with the XBOX® game console.

Having received sound source position data, sound data, the position of the listener and the positions of the speakers, the sound data received is processed to let the listener 280 perceive the processed sound data reproduced by the speakers 242 to originate from a virtual sound position. The virtual sound position is the position where sound is to be perceived to originate from, rather than a position where the speakers 242 are located. By receiving sound data as audio streams recorded per individual member of the pop band 110 (FIG. 1), together with information on the position of each individual member of the pop band 110 and/or positions of microphones 142 and/or electrical or electronic instruments, a spatial sound image provided by the live performance of the pop band 110 can be reconstructed in a room where the listener 280 and the speakers 242 are located.

Figure 4:
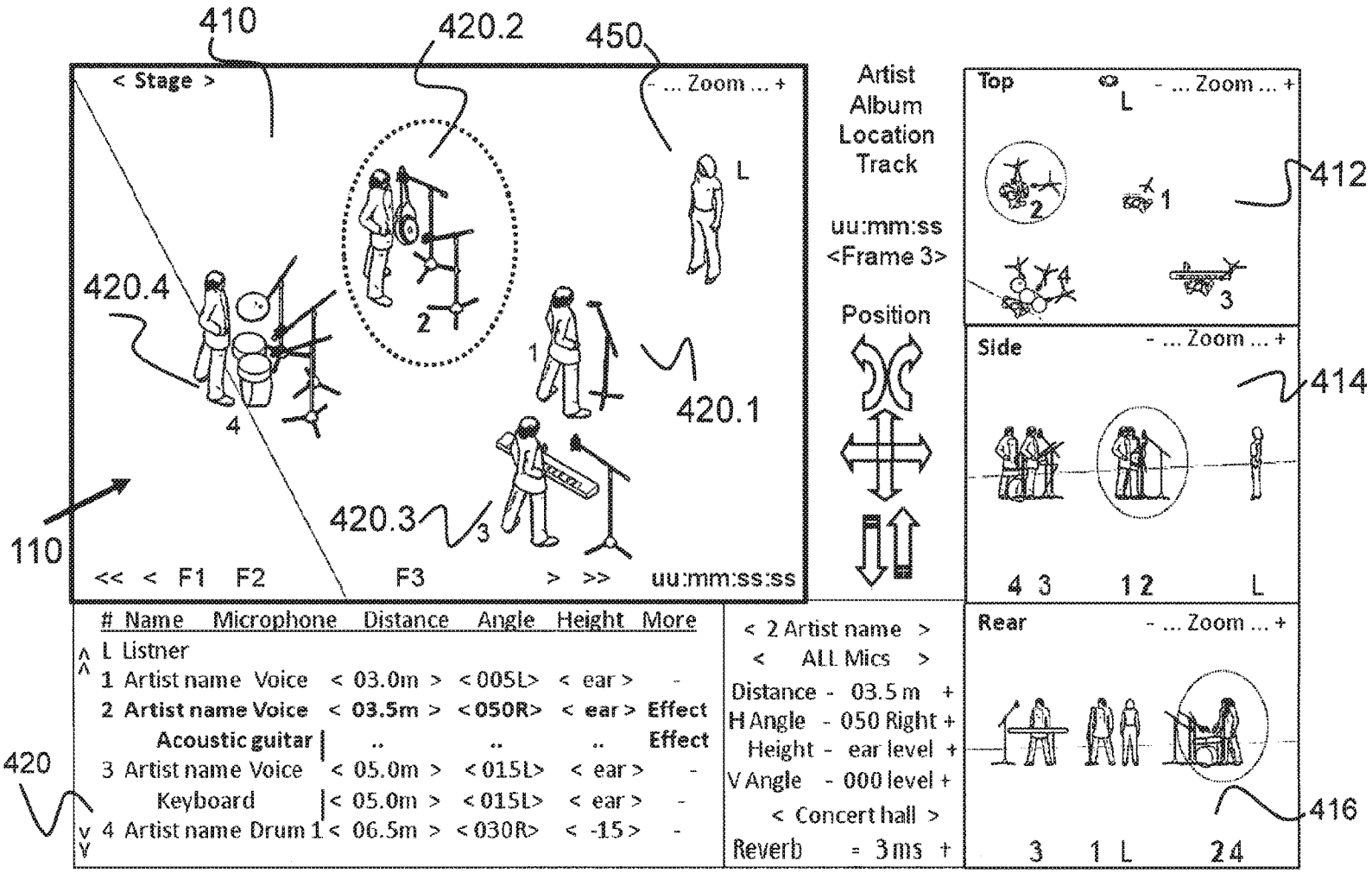
FIG. 4: shows a user interface.

The spatial sound image may be reconstructed with the listener 280 perceiving to be in the centre of the pop band 110 or rather perceiving to be in front of the pop band 110. Such preferences may be entered via a user interface 400 as depicted by FIG. 4. The user interface 400 provides a perspective view window 410, a top view window 412, a side view window 414 and a front view window 416. Additionally, a source information window 420 and a general information window 430 are provided. The user interface 400 can be visualised on the screen 244 or a remote control screen 256 of the remote control 250.

The perspective view window 410 presents band member icons 440 indicating the positions of the members of the pop band 110 as well as a position of a listener icon 450. Per default, the members of the pop band 110 are presented based on position data received by the data receiving module 224. Here, the relative positions of the members of the pop band 110 to one another are of importance. The listener icon 450 is per default presented in front of the band. Alternatively, the listener icon 450 is placed at that or another position as determined by position data accompanying the sound data received. By means of navigation keys 254 provided on the remote control 250, a user of the home cinema system 220 and in particular the listener 280 is enabled to move the icons around in the perspective view window 410. Alternatively or additionally, the user interface 400 is provided on a touch screen and can be controlled by operating the touch screen. The icons provided in the top view window 412, the side view window 414 and the front view window 416 move accordingly with moving the icons in the perspective view window 410.

Upon moving the listener icon 450 relative to the pop member icons 440 in the user interface 400 by means of the navigation keys 254, a spatial sound image provided by the speakers 242 in step 312 is reconstructed differently around the listener 280. If the listener icon 450 is shifted to be in the middle of the pop band icons 440, the spatial sound image provided by the speakers is arranged such that the listener 280 is provided with a first virtual sound source of the lead singer indicated by a first artist icon 440.1 behind the listener 280. The listener 280 is provided with a second virtual sound source of the keyboard player indicated by a second artist icon 440.2 at the left, a third virtual sound source of the guitarist indicated by a third artist icon 440.3 at the right and a fourth virtual sound source of the percussionist indicated by a fourth artist icon 440.4 in front of the listener 280. So the positions of the virtual sound sources are determined or defined by the position data provided with the sound data as received by the data receiving module 224, the positions of the pop member icons and the listener icon 450.

While turning the listener icon 450 180 degrees around its vertical axis in the user interface 400, the first virtual sound source would move from the back of the listener 480 to the front of the listener 480. Other virtual sound sources move accordingly. Additionally or alternatively, the virtual sound sources can also be moved by moving the pop member icons 440. This can be done as a group or by moving individual pop member icons 440.

Additionally or alternatively, the relative position of the listener 280 with respect to the virtual sound sources of the individual artists of the pop band 110 is determined by means of the listener transponder 266 and in particular by means of the signals emitted by the listener transponder 266 received by the sensing module 229. Those skilled in art will appreciate the possibility to determine the acoustic characteristics of the environment, which can be used in the sound processing.

Figure 5:
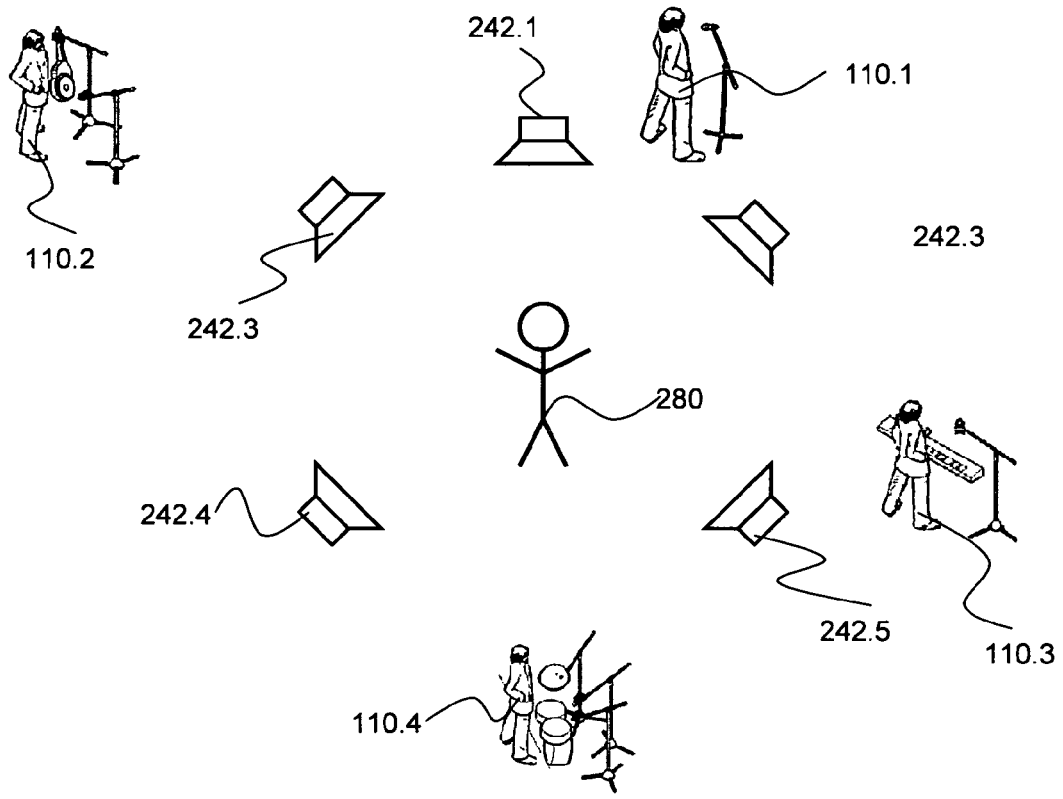
FIG. 5: shows a listener positioned between speakers reconstructing a spatial sound image with virtual sound sources.

The reconstruction of the spatial sound image with the virtual sound sources is provided by the rendering module 226, instructed by the microprocessor 222 based on input received from the remote control 250 to control the user interface 450. This is depicted by FIG. 5. FIG. 5 depicts a listener 280 surrounded by a first speaker 242.1, a second speaker 242.2, a third speaker 242.3, a fourth speaker 242.4, and a fifth speaker 242.5. Sound data previously recorded by means of a microphone 142.1 (FIG. 1) provided with the lead singer 110.1 is particularly processed by the rendering module 226 such that this sound data is provided to and reproduced by the first speaker 242.1 and the second speaker 242.2. Sound data previously recorded by a microphone 142.2 (FIG. 1) provided with the guitarist 110.2 is particularly processed by the rendering module 226 such that this sound data is provided to and reproduced by the second speaker 242.2 and by the fourth speaker 242.4 to a less extent. Additionally or alternatively, psycho-acoustic effects may be employed. Such psycho-acoustic effects may include processing the sound data by filters like comb filters to create surround or pseudo-surround effects.

If a user like the listener 280 rearranges the band member icons 440 and/or the listener icon 450 on the user interface 400 such that all band member icons 440 appear in front of the listener icon 450, this information is processed in step 310 by the microprocessor 222 and the rendering module 226 to define the virtual sound positions in front of the listener 280 and have the sound data related to the lead singer 110.1, keyboard player 110.3, guitarist 110.2 and percussionist 110.4 mainly reproduced by the first speaker 242.1, the second speaker 242.2 and the third speaker 242.3. With the listener icon 450 and a specific band member icon 440 being moved apart on the user interface 400, the sound related to that band member icon will be reproduced with a reduced volume to let the virtual sound source of that band member be perceived as being positioned further away from the listener 280

The embodiments discussed above work in particular well with one listener 280 or multiple listeners sitting closely together. In scenarios with multiple listeners being located further apart from one another, virtual sound sources are more difficult to define for each individual listener in a proper way with a set of speakers in a room where the listeners are located. In such scenarios, headphones are preferred. Such scenario is depicted by FIG. 6.

Figure 6A:
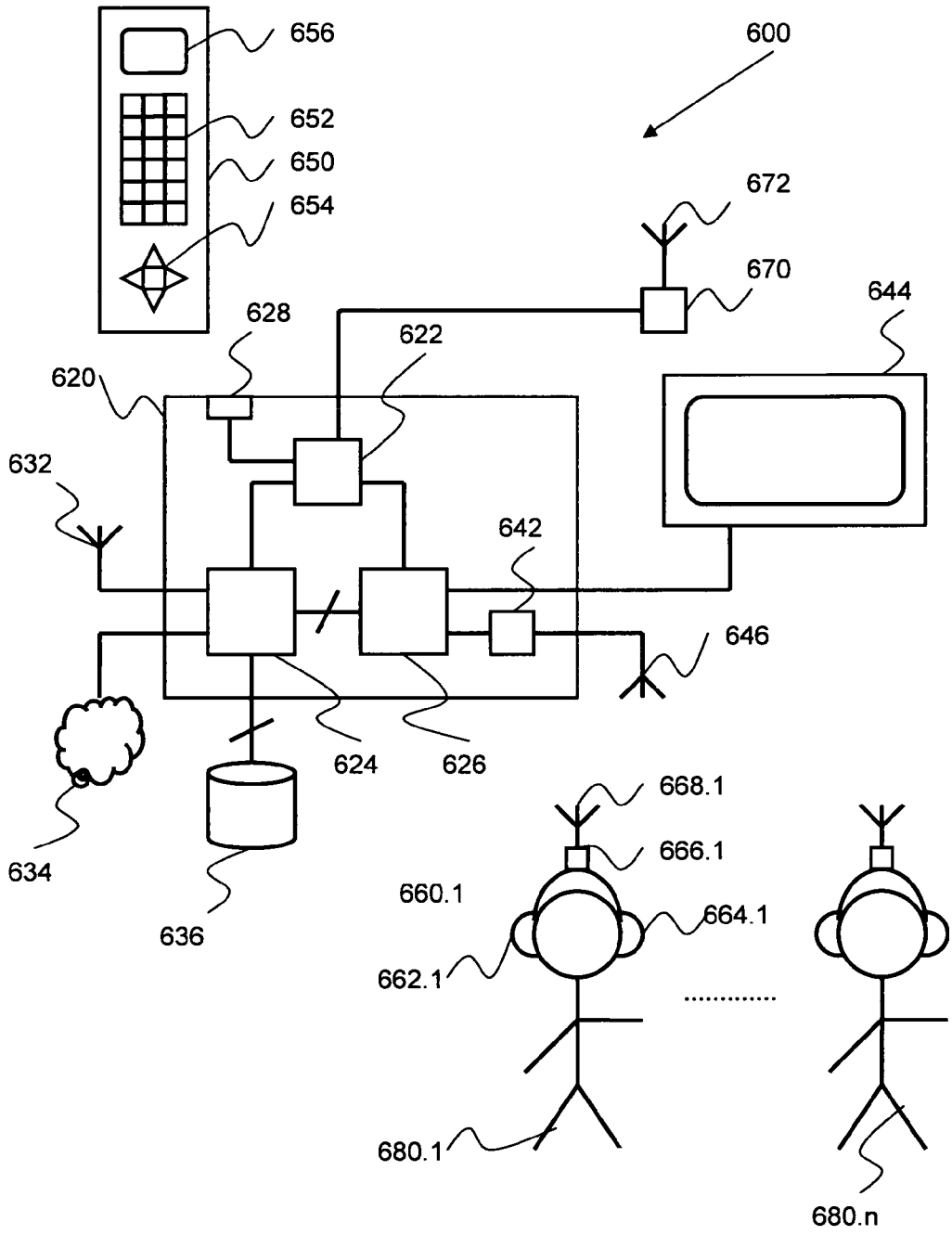
FIG. 6 A: shows a home cinema set connected to headphones.
Figure 6B:
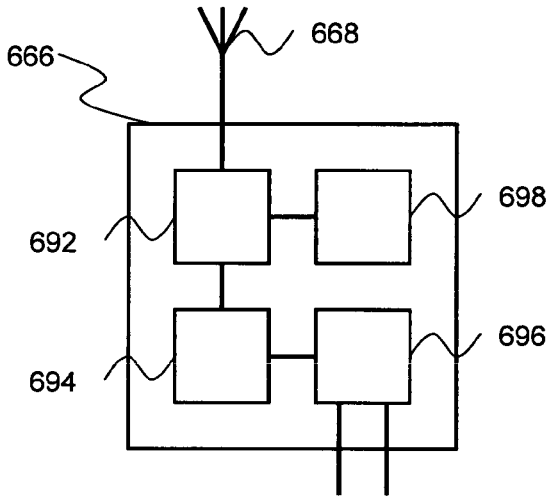

FIG. 6 A discloses a sound system 600 as an embodiment of the sound reproduction system according to the invention. The sound system 600 comprises a home cinema set 620 as an audiovisual data reproduction device, comprising a data receiving module 624 for receiving audiovisual data and in particular sound data from for example the sound recording device 120 (FIG. 1) via a receiving antenna 632, a network 634 or from a data carrier 636, a rendering module 626 for rendering and amplifying audiovisual data on a screen 644 of a television or computer monitor and/or via one or more pairs of headphones 660.1 through **660.*n* via a headphone transmitter 642 that is connected to a headphone transmitter antenna 646**.

The home cinema set 620 further comprises a microprocessor 622 as a controlling module for controlling the various elements of the home cinema set 620, an infra-red transceiver 628 for communicating with a remote control 650 and in particular for receiving instructions for controlling the home cinema set 620 and a headphone position detection module 670 with a headphone detection antenna 672 connected thereto for determining positions of the headphones 660 and with that one or more positions of one or more listeners 680 listening to sound reproduced by the home cinema set 620.

The headphones 660 comprise a left headphone shell 662 and a right headphone shell 664 for providing sound to a left ear and a right ear of the listener 680, respectively. The headphones 660 are connected to a headphone transceiver 666 that has a headphone antenna 668 connected to it.

The home cinema set 620 as depicted by FIG. 6 A works to a large extend similar to the home cinema set 220 as depicted by FIG. 2. Instead of or in addition to having speakers 242 (FIG. 2) connected to it, the rendering module 626 is connected to the headphone transmitter 642. The acoustic characteristics of the headphones 660 are related to the individual listener, so the rendering module 626 may use generalised or individualised head related transfer function or other methods of sound processing for a more realistic sound experience. The headphone transmitter 642 is arranged to provide, by means of the headphone transmitter antenna 646, sound data to the headphone transceiver 666. In turn, the headphone transceiver 666 receives the audio data sent by means of the headphone antenna 668. FIG. 6 B depicts the headphone transceiver 666 in detail.

The headphone transceiver 666 comprises a headphone transceiver module 692 for downmixing sound data received from the home cinema set 620. The headphone transceiver 666 further comprises a headphone decoding module 694. Such decoding may comprise downmixing, decompression, decryption, digital-to-analogue conversion, filtering, other or a combination thereof. The headphone transceiver 666 further comprises a headphone amplifier module 696 for amplifying the decoded sound data and for providing the sound data to the listener 680 in an audible format by means of the left headphone shell 662 and the right headphone shell 664 (FIG. 6 A).

The headphone transceiver 666 further comprises a position determining module 698 for determining the position of the headphone transceiver 666 and with that the position of the listener 680. Position data indicating the position of the headphone transceiver 666 is by means of the headphone transceiver module 692 and the headphone antenna 668 sent to the home cinema set 620. The home cinema set 620 receives the position data by means of the headphone position detection module 670 and the headphone detection antenna 672. Position parameters comprised by the position data that can be determined by the position determining module 698 may include, but are not limited to, distance between the headphone detection antenna 672 and the headphone transceiver 666, bearing of the headphone transceiver 666, Cartesian coordinates, either relative to the headphone detection antenna or absolute global Cartesian coordinates, spherical coordinates, either relative or absolute on a global scale, other or a combination thereof. Absolute coordinates or a global scale can for example be obtained by means of the Global Positioning System, the Galileo satellite navigation system. Relative coordinates can be obtained in a similar way, with the headphone position detection module 670 fulfilling the role of satellites in global position determining systems.

The headphone transmitter 642 as well as the headphone position detection module 670 are arranged to communicate with multiple headphones 660. This allows the home cinema system 620 to provide each of the n listeners from the first listener 680.1 through the nth listener **680.*n* with his or her own spatial sound image. For providing separate spatial sound images for each of the listeners 680, the virtual sound positions as depicted in FIG. 5 are in one embodiment defined at fixed positions in a room where the listeners 680 are located. In another embodiment, the virtual sound positions are differently defined for each of the listener. This may be enhanced by providing each individual listener 680 with a dedicated user interface 400**.

The first of these two latter embodiments is particularly advantageous if two or more listeners are free to move in a room. By walking or otherwise moving through the room, a listener 680 can move closer to a virtual sound source position defined in the room. By moving closer, the sound related to that virtual sound position is reproduced at a higher volume by the left headphone shell 662 and the right headphone shell 664. Furthermore, if this listener 680 turn 90 degrees clockwise around his or her top axis, the spatial sound image provided to and reproduced by the left headphone shell 662 and the right headphone shell 664 is also turned 90 degrees, independent from other spatial sound images provided to other headphones 660 of other listeners 680. This embodiment is in particular advantageous in an Imax theatre or equivalent theatre with multiple screens or a museum where an audio guide is provided. In the latter case, the virtual sound source would be a painting where people move around. The latter scenario is particularly advantageous as one would not have to search for a painting by means of tiny numbers provided next to paintings.

The second of these latter embodiments is particularly advantageous if multiple listeners 680 prefer other listening experiences. A first listener 680.1 may prefer to listen to the sound of the pop band 110 (FIG. 1) as experienced in the middle of the pop band 110, whereas a second listener 680.2 may prefer to listen to the sound of the pop band 110 as experienced while standing ten meters in front of the pop band 110.

In both cases, each of the n headphones 660 is provided with a separate spatial sound image. The spatial sound images are constructed based on sound streams received by the data receiving module 624, position data related to those sound streams indicating virtual sound source positions for these sound streams, virtual sound source positions defined for example by means of a user interface as or similar to the user interface 400 (FIG. 4), positions of the listeners in a room, either absolute or relative to the headphone position detection module 670, other, or a combination thereof.

Figure 7:
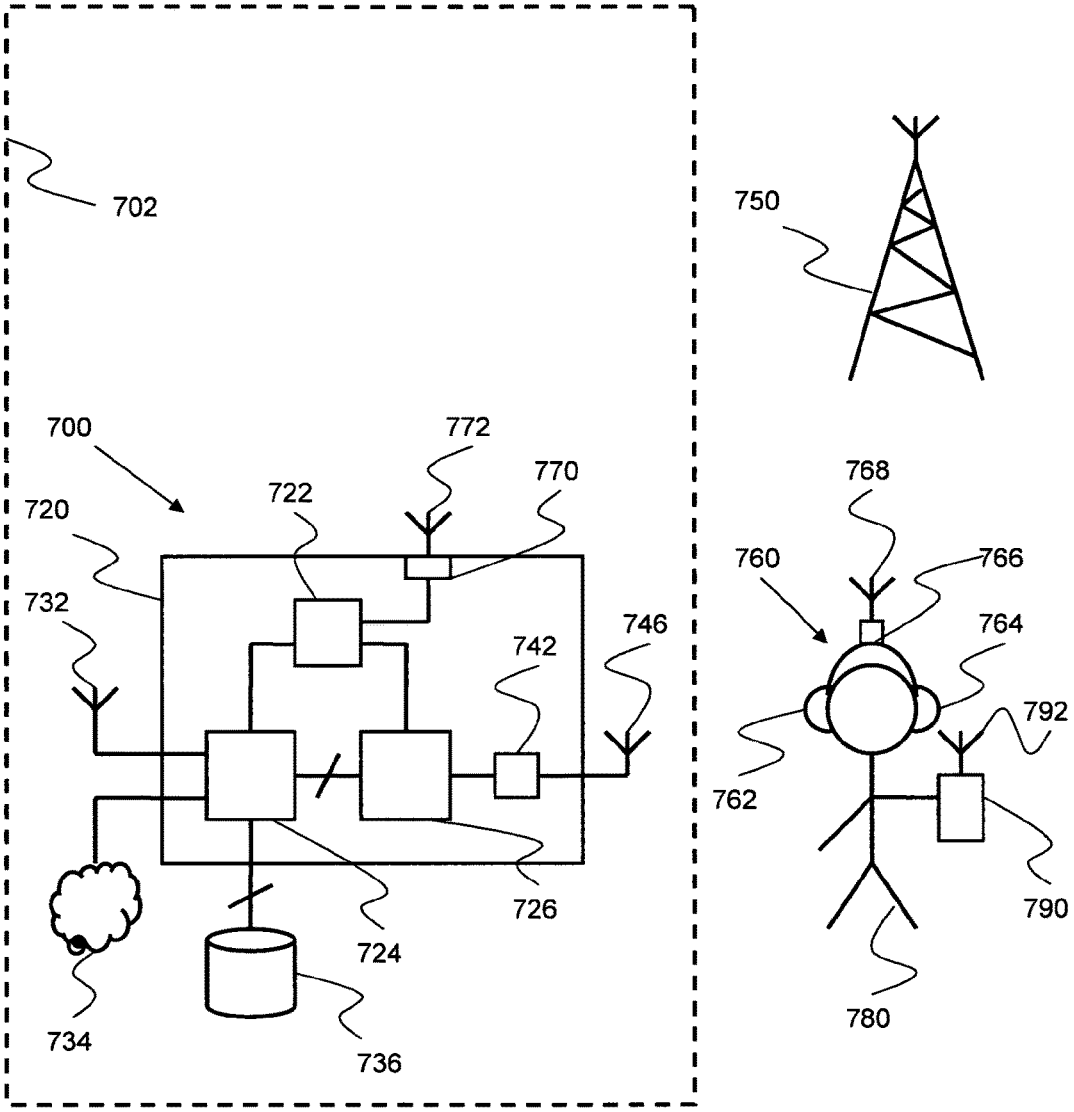
FIG. 7: shows a messaging device.

FIG. 7 depicts another embodiment of the invention in another scenario. FIG. 7 shows a commercial messaging system 700 comprising a messaging device 720. The messaging device is arranged to send commercial messages to one or more listeners 780. The messaging device 720 comprises a data receiving module 724 for receiving audiovisual data and in particular sound data from for example the sound recording device 120 (FIG. 1) via a receiving antenna 732, a network 734 or a data carrier 736, a rendering module 726 for rendering and amplifying audiovisual data via one or more pairs of headphones 760 via a headphone transmitter 742 that is connected to a headphone transmitter antenna 746. The pair of headphones 760 comprises a left headphone shell 762 and a right headphone shell 764 for providing audible sound data to the listener 780.

In one embodiment, the pair of headphones 760 comprises a headphone transceiver 766 that has a headphone antenna 768 connected to it. The headphone transceiver 766 comprises similar or equivalent modules as the headphone transceiver 666 as depicted by FIG. 6 B and will not be discussed in further detail. In another embodiment, the pair of headphones 760 does not comprises a headphone transceiver. In this particular embodiment, the pair of headphones 760 is connected to a mobile telephone 790 held by the listener 780 for providing sound data to the pair of headphones 760. The mobile telephone comprises in this embodiment similar or equivalent modules as the headphone transceiver 666 as depicted by FIG. 6 B.

The messaging device 720 further comprises a microprocessor 722 as a controlling module for controlling the various elements of the home cinema set 720 and a listener position detection module 770 with a headphone detection antenna 772 connected thereto for determining positions of the headphones 760 and with that one or more positions of one or more listeners 780 listening to sound reproduced by the messaging device 720. Alternatively, the position of the listener 780 is determined by determining the position of the mobile telephone 790 held by the listener 780. More and more mobile telephones like the mobile telephone 790 depicted by FIG. 7 comprise a satellite navigation receiver, by means of which the position of the mobile telephone 790 can be determined. Additionally or alternatively, the position of the mobile telephone 790 is determined by a triangular measurement determining the position of the mobile telephone 790 relative to multiple and preferably at least three base stations or beacons of which the position is know.

Figure 8:
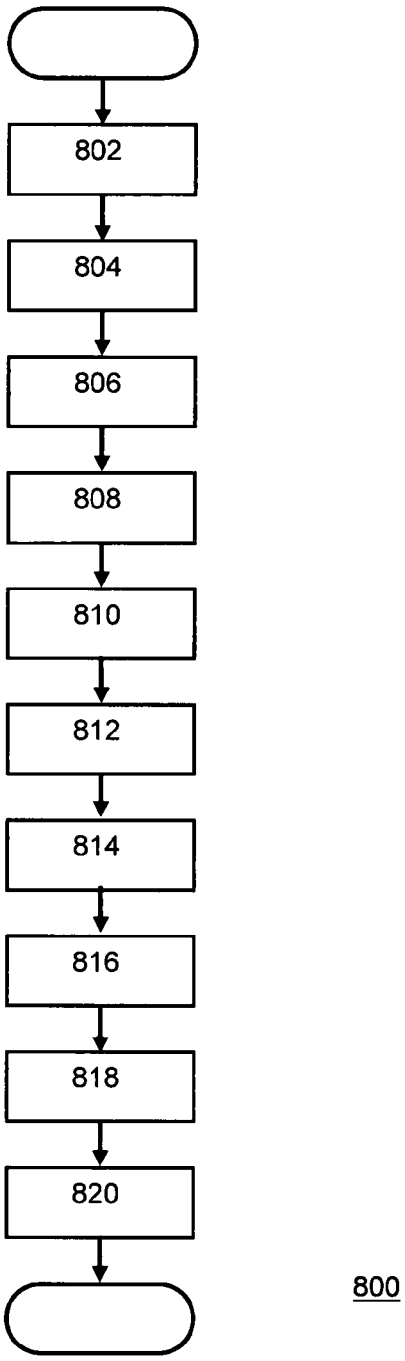
FIG. 8: shows a flowchart.

The commercial messaging system 700 is particularly arranged for sending commercial messages or other types of messages that are by the listener 780 perceived as originating from a particular location, either dynamic (mobile) or static (fixed). In a particular scenario in a street with a shop 702 in or close to which the commercial messaging system 700 is located, the listener 780 and his or her location are obtained by the commercial messaging system 700 by receiving position data related to the listener 780. Subsequently, sound data is rendered such that with the rendered or processed sound data being provided to the listener 780 by means of the pair of headphones 760, the sound reproduced by the pair of headphones 760 appears to originate by the shop 702. This will be further elucidated by means of a flowchart 800 depicted by FIG. 8 and of which the table below provides short descriptions of the steps.

| Step | Description |
|---|---|
| 802 | Identify listener |
| 804 | Request listener position data |
| 806 | Determine listener position |
| 808 | Send listener position data |
| 810 | Receive listener position data |
| 812 | Retrieve sound data |

-continued

| Step | Description |
|---|---|
| 814 | Render sound data |
| 816 | Transmit rendered sound data |
| 818 | Receive rendered sound data |
| 820 | Reproduce rendered sound data |

In step 802, the listener 780 identifies himself or herself by means of the mobile telephone 790 as a mobile communication device. This can for example be established by the listener 780 moving into a specific communication cell of a cellular network, which communication cell comprises the location of the shop 702. Entry of the listener 780 in the communication cell is detected by a base station 750 in the communication cell taking over communication to the mobile telephone 790 from another base station of another communication cell.

Upon the entry of the listener 780 in the communication cell, the listener 780 is identified by means of the International Mobile Equipment Identity (IMEI) of the mobile telephone 790 or the number of the Subscriber Identity Module (SIM) of the mobile telephone 790. These are elements that are part of for example the GSM standard and subsequent generations thereof. Additionally or alternatively, other data may be used for identifying the listener 780. In the identification step, it is optionally determined whether the listener 780 wishes to receive commercial messages and in particular commercial sound messages. If the listener 780 desires not to receive such messages, the process depicted by the flowchart 800 terminates. The identification of the listener 780 is communicated from the base station 750 to the messaging device 720.

Alternatively, the listener 780 is identified directly by the messaging device 720 by means of other network protocols and/or standards than used for mobile telephony, like WiFi in accordance with any of the IEEE 802.11 standards, WiMax or another network. In particular upon entry of the listener 780 in the range of the headphone transmitter 742 or the listener position detection module 770, the listener 780 is detected and queried for identification and may be connected to the messaging device 720 via a wireless communication connection.

After identification of the listener 780, the listener 780, the mobile telephone 790 and/or the headphone transceiver 766 are queried for providing position data related to the position of the listener 780 in a step 804. In response to this query, a position determining module comprised either by the mobile telephone 790 or the headphone transceiver 766 determines its position in a step 806. As the mobile telephone 790 or the headphone transceiver 766 are held by the listener 780, the positions are substantially the same.

The position data may comprise coordinates of the position of the listener on the earth, provided by latitude and longitude in degrees, minutes and seconds or other entities and altitude in meters or another entity. Such information may be obtained by means of a navigation system like the Global Positioning System, the Galileo system, another navigation system or a combination thereof. Alternatively, the position data may be obtained on a local scale by means of local beacons. In a particular preferred embodiment, the bearing of the listener 780 and in particular of the head of the listener 780 is provided. Alternatively, the heading of the listener 780 is determined by following movements of the listener 780 for a pre-determined period in time. These two parameters—heading and bearing will be referred to as angular position of the listener 780. After the position data has been obtained, it is sent to the messaging device 720 in a step 808 by means of a transceiver module in the headphone transceiver 766 or the mobile telephone.

The position data sent is received by the listener position detection module 770 with the headphone detection antenna 772 in a step 810. In certain embodiments, the position data received requires post processing. This is in particular the case if the position data comprises coordinates of the listener on the earth, as in this scenario the position of the listener relative to the messaging device 720 and/or to a shop 702 to which the messaging device 720 is related is a relevant parameter. In case the position data is determined by means of dedicated beacons, for example located close to the messaging device 720, the position of the listener 780 relative to the messaging device 720 may be determined directly and sent to the messaging device.

Subsequently, sound data to be provided to the listener 780 is retrieved by the data receiving module 724 in a step 812. Such sound data is in this scenario a commercial message related to the shop 702 to catch the interest of the listener 780 to visit the shop 702 for a purchase. Upon retrieval of the sound data by the data receiving module 724 from a remote source via the receiving antenna 732, the network 734 or from the data carrier 736, the sound data is rendered in a step 814 by the rendering module 726. The rendering step is instructed and controlled by the microprocessor 722 employing the position data on the position of the listener 780 received earlier. A person skilled in the art will appreciate that the rendered sound may be rendered in an individualised way based on the identification of the listener 780 in the step 802. For example, the listener 780 may provide further information enabling the messaging device 720 and in particular the rendering module 726 identifying the listener 780 as a particular individual having for example particular preferences on how sound data is preferred to be received.

The sound data is rendered such that when reproduced in audible format by the left headphone shell 762 and the right headphone shell 764 of the pair of headphones 760, a source of the sound appears to be the location of the shop 702. This means that the sound data is rendered to provide the listener with a spatial sound image via the pair of headphones 760 with the shop 702 as a virtual sound source, so where the shop 702 is a virtual sound source position. When the listener 780 approaches the shop 702 from the north through a street, where the shop 702 is located on the right side of the street, the sound rendered and provided by the pair of headphones 760 is by the listener perceived as coming from the south, from a location in front of the listener 780.

While getting closer to the shop, the sound will appear more and more from the south west, so from the right front of the listener 780 and the volume of the sound will increase. Optionally, when also data on the angular position of the listener is available and when the listener turns his or her head, the spatial sound image will be provided accordingly. This means that when the listener 780 turns his or her head to the right, the sound rendered to be perceived to originate from the virtual sound source position of the shop, so the sound will be provided more via the left headphone shell 762. So the sound data retrieved by the data receiving module 724 will be rendered by the rendering module 726 using the position data received such that in the perception of the listener, the sound will always appear to originate from a fixed geographical location.

In a subsequent step 816, the rendered sound data comprising the spatial sound image thus created is transmitted by the headphone transmitter 742. The sound data may be transmitted to the mobile telephone 790 to which the pair of headphones is operatively connected for providing sound data. Alternatively, the sound data is sent to the headphone transceiver 766.

The rendered sound data thus sent is received in a step 818 by the headphone transceiver 766 or the mobile telephone 790. In the latter case, the sound data may be transmitted via a cellular communication network like a GSM network, though a person skilled in the art will appreciate that this may not always be advantageous in view of cost, depending on the subscription of the listener 780. Rather, the sound data is transmitted via an IEEE 802.11 protocol or an equivalent public standardised or proprietary protocol.

The sound data received is subsequently mixed down, decoded, amplified, processed otherwise or a combination thereof and provided to the left headphone shell 762 and the right headphone shell 764 of the pair of headphones 760 for reproduction of the rendered sound data in an audible format, thus constructing the desired spatial sound image and providing that to the listener 780.

Figure 9:
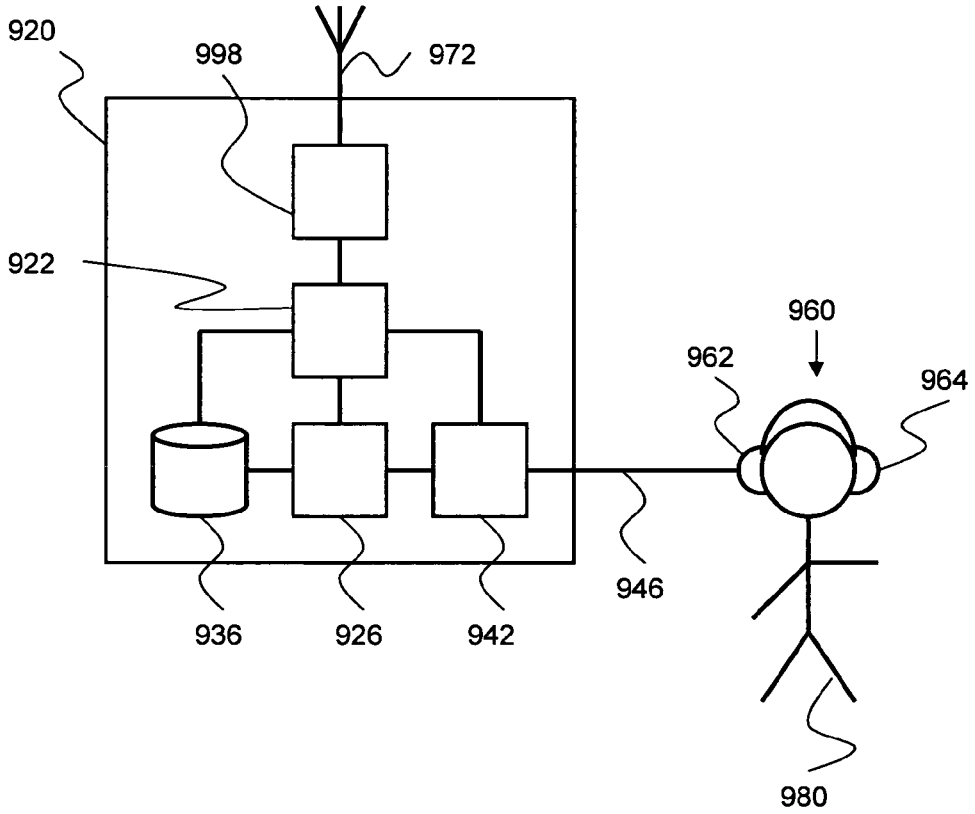
FIG. 9: shows a portable device.

In a similar scenario depicted by FIG. 9, sound data may also be provided to a listener 980 without an operational communication link between the messaging device 720 (FIG. 7) and a device carried by the listener 980.

The mobile device 920 comprises a storage module 936, a rendering module 926, a headphone transmitter 942, a position determining module 998 connected to a position antenna 972 and a microprocessor 922 for controlling the various elements of the mobile device 920. The mobile device 920 is via a headphone connection 946 connected to a pair of headphones 960 comprising a left headphone shell 962 and a right headphone shell 964 for providing sound in audible format to a left ear and a right ear of the listener 980. The headphone connection 946 may be an electrically conductive connection or a wireless connection, for example in accordance with the BLUETOOTH® protocol or a proprietary protocol.

In the storage module 936, sound data is stored. Additionally, position data of a geographical location is stored, that is in this scenario related to a shop. Alternatively or additionally, position data related to or indicating geographical location of other places or persons of interest may be stored. The position data may be fixed (static) or varying (dynamic). In particular in case the position data is dynamic, but also in case the position data is static, it may be updated in the storage module 936. The updates would be received through a communication module comprised by the mobile device 920. Such communication module could be a GSM transceiver or equivalent for that purpose. The stored position data is in this scenario the virtual sound source position, which concept has been discussed before.

The sound data is provided to the rendering module 926. The stored position data is be provided to the microprocessor 922. The position determining module 998 determines the position of the mobile device 920 and with that the position of listener 980. The listener position can be determined by receiving signals for satellites of the GPS system, the Galileo system or other navigation or location determination systems via the position antenna 972 and in case required, post processing the information received. The listener position data is provided to the microprocessor 922.

The microprocessor 922 determines the listener position and the stored position relative to one another. Based on the results of this processing, the rendering module 926 is instructed to render the provided sound data such that the listener perceives audible sound data provided to the pair of headphones 960 to originate from a location defined by the stored position data.

Providing the rendered sound data to the listener can be triggered in various ways. In a preferred embodiment, the listener position is determined continuously or a regular intervals, preferably at periodical intervals. The listener position data is upon acquisition processed together with one or more locations identified by stored position data by the microprocessor 922. When the listener 980 is within a pre-determined range of a location identified by stored position data, for example within a radius of 50 meters from the location, the portable device 920 retrieves sound data associated with the location and will start rendering the sound data as discussed above.

As discussed above, in case the position data is dynamic, but also in case the position data is static, it may be updated in the storage module 936. This is advantageous in a scenario where the listener 980 listens to and in particular communicates with a mobile data source like another listener. In one scenario, the other listener continuously or at least regularly communicates his or her position to the listener 980, together with sound information, for example a conversation between the two listeners. The listener 980 would perceive sound data provided by the other listener as originating from the position of the other listener. Position data related to the other listener is received through the position determining module 998 and used for processing of sound data received for creating the desired spatial sound image. The spatial sound image is constructed such that when provided to the listener 980, the listener would perceive the sound data as originating directly from the position of the other listener.

This embodiment, but also other embodiments can also be employed in city tours, a museum or exhibition with several items on display, like paintings. As the listener 780 comes within a ten meters range of a painting, data on the painting will automatically be provided to the listener 780 in an audible format as discussed above, with a virtual sound source being located at or near the painting. Alternatively or additionally, ambient sounds may be provided with the data on the painting enhancing the experience of the painting. For example, if the listener 780 would be provided with sound data on the painting "La gare Saint Lazare" of Claude Monet with the location of the painting in the museum as a virtual sound source for the data discussing the painting, the listener can also be provided with an additional spatial sound image with railway station sounds being perceived to originate from a sound source other than the painting, so having another virtual sound source. In a city tour, this and other embodiments can also be combined with a mobile information application like Layar and other.

The invention claimed is:

1. A method of processing sound data comprising:

a) receiving sound data comprising a plurality of streams, each of said plurality of streams corresponding to a single specific artist and consisting of:

a sound recording of said single specific artist recorded by a single microphone, and location data indicating a position of said single specific artist during said sound recording by said single microphone;

b) defining for each of said plurality of streams a virtual sound source position which per default represents the position of the single specific artist during said sound recording of the respective stream, c) defining a relative position of a listener with respect to each of said virtual sound source positions; and d) receiving, from a user interface, user input for moving one of said relative position of said listener or at least one of said virtual sound source positions; and e) processing the sound data for reproduction through at least two speakers to let the listener perceive the processed sound data reproduced by the two speakers to originate from said virtual sound source positions in accordance with the position of said listener relative to said virtual sound source positions.

2. The method according to claim 1, wherein processing the sound data for reproduction comprises at least one of the following:

a) processing the sound data such that when reproduced by a first speaker of said at least two speakers as audible sound results in a decrease of sound volume when a distance between said relative position of said listener and one of said virtual sound source positions increases; or b) processing the sound data such that when reproduced by a first speaker of said at least two speakers as audible sound results in an increase of sound volume when a distance between said relative position of said listener and one of said virtual sound source positions decreases.

3. The method according to claim 1, wherein a) the two speakers are comprised by a pair of headphones arranged to be worn by a head of the listener;

b) determining the relative position of the listener comprises determining an angular position of the headphones; and c) processing the sound data for reproduction further comprises when the angular data indicates that a first speaker of said at least two speakers is closest to the virtual sound source positions the sound data is processed such that when reproduced by the first speaker of said at least two speakers as audible sound results in an increase of sound volume and when reproduced by a second speaker of said at least two speakers as audible sound results in a decrease of sound volume.

4. The method according to claim 1, wherein determining the relative position of the listener comprises at least one of the following:

a) receiving sensor data indicating a position of the listener;

b) receiving pre-determined data on a position of the listener;

c) receiving geolocation data indicating a position of the listener; or d) receiving location data by means of a user input.

5. The method according to claim 4, wherein the pre-determined data on a position of the listener is a) received from a device available in close proximity of the listener; or b) provided with the sound data.

6. The method according to claim 1, wherein processing the sound data for reproduction comprises determining a relative position of the listener relative to a first speaker and/or a second speaker.

7. The method according to claim 1, wherein determining the virtual sound source positions comprises at least one of the following:

a) receiving user input indicating the virtual sound source positions; or b) receiving sound source position data provided with the sound data.

8. The method according to claim 1, further comprising:

a) providing a user interface indicating at least one virtual sound position and the listener position and the relative positions of the virtual sound position and the listener to one another;

b) receiving user input on changing the relative positions of the virtual sound position and the listener to one another; and c) processing further sound data received for reproduction by a speaker to let the listener perceive the processed sound data reproduced by the speaker to originate from the changed virtual sound position.

9. A device for processing sound data comprising:

a) a sound data receiving module, configured for receiving sound data comprising a plurality of streams, each of said plurality of streams corresponding to a single specific artist and consisting of:

a sound recording of said single specific artist recorded by a single microphone, and location data indicating a position of said single specific artist during said sound recording by said single microphone;

b) a microcontroller, configured for defining for each of said plurality of streams a virtual sound source position which per default represents the position of the single specific artist during said sound recording of the respective stream;

c) a listener position data receiving module, configured for defining a relative position of a listener with respect to each of said virtual sound source positions; and c) a user interface configured for receiving user input for moving one of said relative position of said listener or at least one of said virtual sound source positions; and d) a data rendering unit, configured for processing the sound data for reproduction through at least two speakers to let the listener perceive the processed sound data reproduced by the two speakers to originate from said virtual sound source positions in accordance with the position of said listener relative to said virtual sound source positions.

10. The device according to claim 9, wherein the listener position data receiving module comprises at least one sensor for sensing a position of the listener.

11. The device according to claim 9, wherein the microcontroller is connected to a memory module and configured for storing the virtual sound source positions.

* * * * *